United States Patent [19]

Meek

[11] 4,036,144

[45] July 19, 1977

[54] ARMING SYSTEM

[75] Inventor: James M. Meek, Silver Spring, Md.

[73] Assignee: The United States of America as represented by the Secretary of the Army, Washington, D.C.

[21] Appl. No.: 790,028

[22] Filed: Jan. 29, 1959

[51] Int. Cl.[2] ..... F42C 15/40

[52] U.S. Cl. ..... 102/70.2 R

[58] Field of Search ..... 102/70.2, 76, 71, 82, 102/84, 81.2

[56] References Cited

U.S. PATENT DOCUMENTS

| | | | |
|---|---|---|---|
| 2,060,198 | 11/1936 | Hammond | 102/70.2 |
| 2,411,788 | 11/1946 | Hammond | 102/70.2 |
| 2,642,801 | 6/1953 | Gleason | 102/70.2 |
| 2,713,308 | 7/1955 | Brown | 102/70.2 |
| 2,805,623 | 9/1957 | Blair | 102/81.2 |
| 2,839,998 | 6/1958 | Rabinow | 102/81.2 |

*Primary Examiner*—Charles T. Jordan

*Attorney, Agent, or Firm*—Nathan Edelberg; Robert P. Gibson; Saul Elbaum

EXEMPLARY CLAIM

1. An arming system for use in an ordnance missile, said system consisting of two parts contained within said missile and electrical wiring connections for transmitting electrical signals therebetween, the first part comprising: an arming rotor, a spring biasing said rotor for rotation to an armed position, means for locking said rotor against rotation to said armed position, said means adapted to unlock said rotor for rotation when said means receives a series of electrical signals of predetermined duration in a predetermined sequence from said electrical wiring connections; the second part comprising: a series of environmental sensing switches each adapted to close in response to a predetermined condition which the missile experiences during proper missile flight, a distributor, contacts adapted to be closed by said distributor in a predetermined sequence and for predetermined time periods, and a source of electrical power connected to said contacts and to said electrical wiring connections, so that said series of electrical signals is applied to said electrical wiring connections.

4 Claims, 9 Drawing Figures

INVENTOR
JAMES M. MEEK

BY S. J. Rotondi, A. J. Dupont, J. E. McGee & N. Cass

INVENTOR
JAMES M. MEEK

BY S. J. Rotondi, A. D. Dupont, J. E. McGee & N. Cass

INVENTOR
JAMES M. MEEK

BY S. J. Rotundi, A. J. Dupont, L. E. McGee & N. Cass

ARMING SYSTEM

The invention described herein may be manufactured and used by or for the Government for governmental purposes without the payment to me of any royalty thereon.

This invention relates to ordnance arming systems in general, and more particularly to a partially universal type of arming system which can readily be incorporated in a wide variety of missile fuzing systems.

Typical recent safety requirements for guided missile fuzing systems range from less than one failure of safety in ten thousand to one in one million. Since the safety and reliability of the arming system are important factors in any fuzing system, their determination is of paramount importance. However, the safety and reliability rates are not readily determinable because of the complexity of the arming system. In order to get some idea of its actual safety and reliability, the arming system must first be developed to an advanced state, and then at least hundreds or thousands of tests must be performed. Because of these numerous tests, the cost of developing a missile arming system takes an undue amount of time, and because a different arming system is required for different types of missiles, this problem is multiplied many times. As a result, designers have sought to produce a universal arming system which could be satisfactorily used in most types of missiles, even though they may operate over widely varying conditions.

As one way of providing at least a partially universal arming system, it was thought desirable to have the system arranged in two parts. One part would comprise the rotor and rotor actuating means which would be essentially the same for all missiles, and the other part would comprise the environmental sensing means, with communication between the two being provided by electrical means. When the environmental sensing means indicated the missile has experienced the conditions required for arming, it would then transfer the proper electrical signals to the first part to cause the rotor actuating means to rotate the rotor, aligning the explosive train, and thereby providing arming. Such a two-part system has never been adapted because it was thought that it would not be able to provide a high degree of safety. The reason for this is that electrical signals are not unique and might be applied to the rotor actuating means as a result of many not impropable circumstances. Shorted or crossed circuits in the missile, improper wiring in the missile, undetected electrical initiation during storage, and freak occurrences of static or induced electrical potentials are examples of circumstances which might cause premature arming.

In accordance with the present invention, however, it has been discovered that a two-part system as described above, with its advantage of greater universality, could be provided which would have the necessary high degree of safety heretofore thought impossible. This is accomplished in the present invention in the following two ways: (1 ) means are incorporated in the environmental sensing part of the system to transform the indications from the environmental sensing means into a predetermined sequence of signals; and (2 ) means are incorporated in the rotor part of the system to prevent rotation of the rotor until each of the predetermined sequence of signals are received in their proper order at their proper time intervals, and continue for at least a predetermined minimum period of time.

In a typical embodiment of the invention, the first part comprises a spring-biased arming rotor which is locked by three half-shafts located in matching hemispherical grooves symmetrically placed around the periphery of the rotor. Each of these three shafts is connected to a slow speed motor by means of a gearing arrangement such that each shaft rotates at a different speed. Also, each shaft is adapted to be out of locking engagement with the rotor only for a very limited portion of one revolution. Thus, only when all three half-shafts are in this very limited position of rotation will the rotor be able to rotate and cause arming. It can be seen, therefore, that a very particular application o energizing signals to the motors will be necessary to cause the condition where all three shafts are simultaneously out of locking engagement. Consequently, the possibility of spurious signals or improper wiring causing arming is infinitesimal.

The second part of the present invention typically comprises a sequential timing mechanism in combination with the environmental sensing means such that indications of environment and proper missile operation are formed into a predetermined sequence of motor energizing signals. These signals are applied to the first part of the arming system described above to energize the motors in such a way that the half-shafts preventing rotation of the rotor will simultaneously be out of locking engagement with the motor, thereby permitting the rotor to rotate and arm the missile.

It is a broad object of the present invention, therefore, to provide an arming system having greater universality than heretofore was possible, coupled with the provision of a high degree of safety.

Another object is to provide a reliable two-part arming system, at least one part of which can be made universal for a wide variety of different types of missiles.

It is another object of this invention to provide a reliable two-part arming system having a very high degree of safety.

It is a further object of this invention to provide an arming system in accordance with the foregoing objects, which is additionally simple and compact so as to be readily incorporated into present day missile fuzing systems.

The specific nature of the invention, as well as other objects, uses, and advantages thereof, will clearly appear from the following description and from the accompanying drawing, in which.

Figure 1:
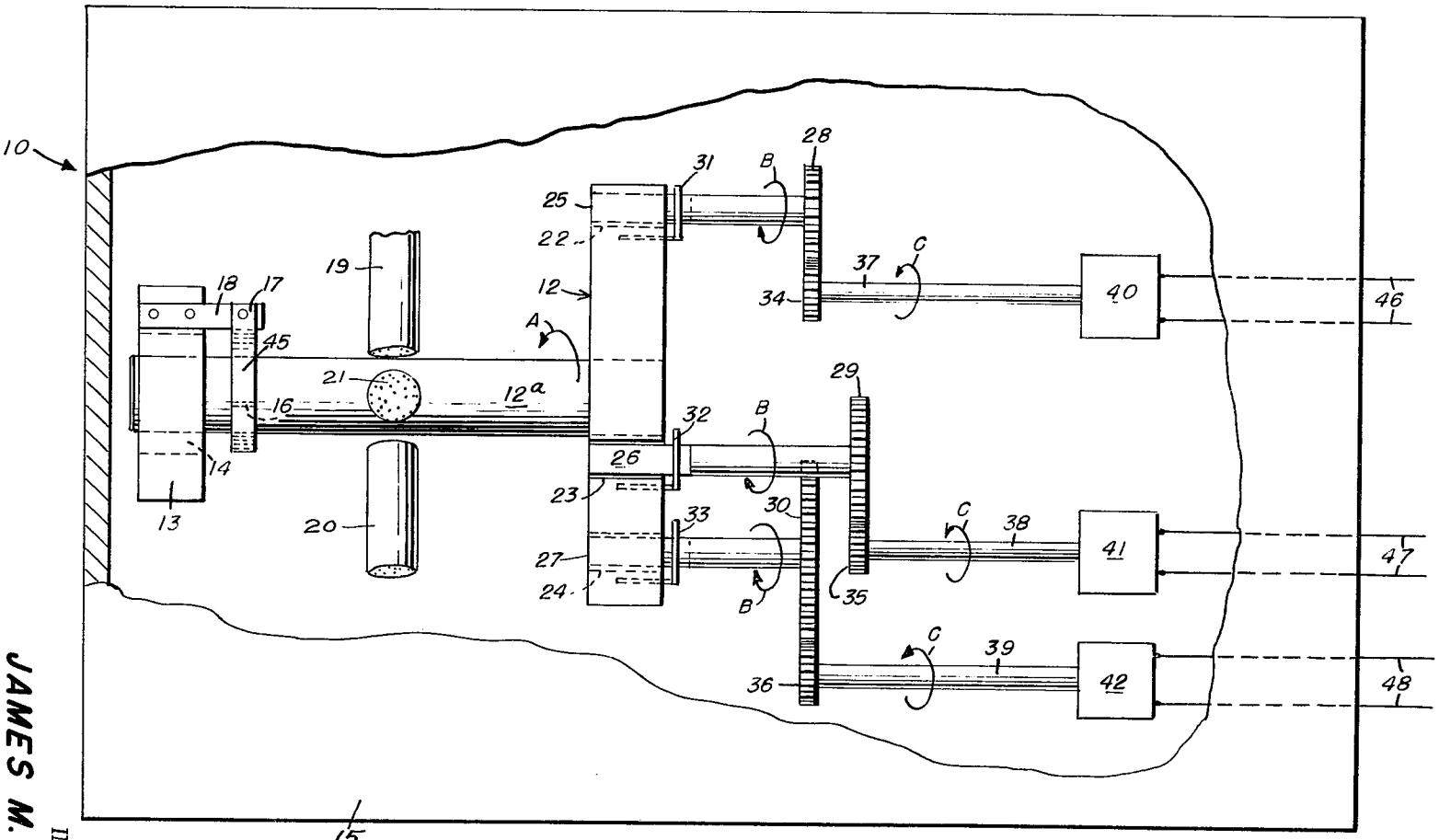
FIG. 1 is a schematic view of one part of the two-part arming system of this invention.
Figure 2:
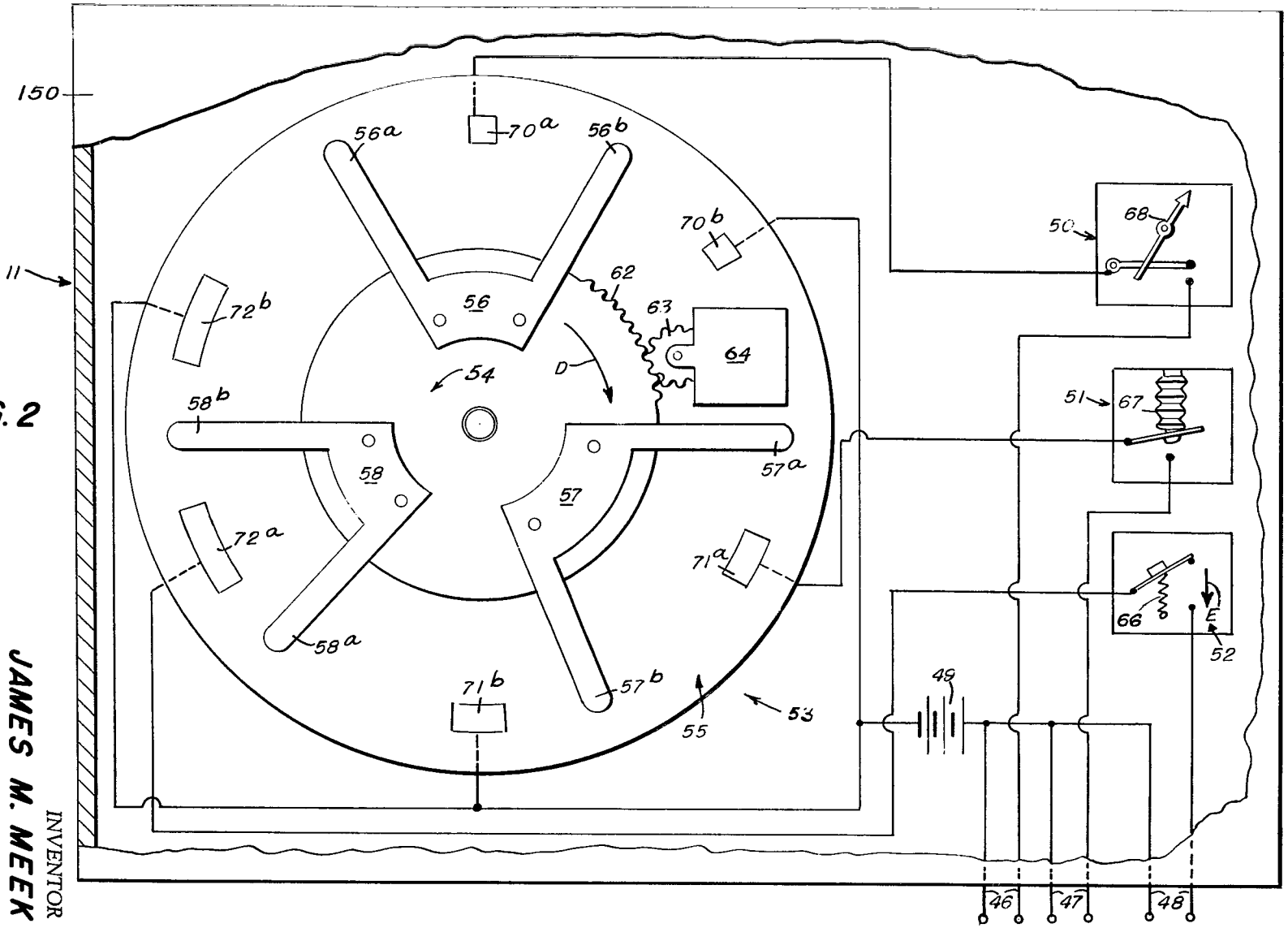
FIG. 2 is a schematic diagram of the second part of the arming system of the invention.

Referring now to FIGS. 1 and 2, there are shown in the first and second parts of the arming system 10 and 11, which may be housed in packages 15 and 150, respectively. It is to be understood that the components of the system may be located wherever desired within the missile, the use of the packages 15 and 150 being merely exemplary. The first part will hereafter be referred to as the rotor actuating unit and the second part as the environmental sensing unit.

FIG. 1 shows in detail a cylindrical rotor 12 and a shaft **12*a*** which is affixed concentrically at one end to rotor 12. The other end of shaft 12*a* is rotatably mounted to package 15 by means of bracket 13 which contains a roller bearing 14. Spring 45 has one end 16 embedded into shaft 12*a* and the other end 17 fixed to block 18, the latter being fixed to bracket 13. Spring 45 is designed to resiliently urge shaft 12*a* and rotor 12 in the direction shown by arrow A.

Passing through shaft 12*a* is a powder-filled cavity 21 which is initially 90° out of line with the interrupted portions of the missile explosive train indicated by the elements 19 and 20. The missile explosive train elements are shown schematically in FIG. 1, and those in the art can readily provide the necessary constructional details. In regard to the present invention, it is only necessary to realize that the missile remains safe and unarmed as long as the powder-filled cavity 21 is out of alignment with the explosive from elements 19 and 20.

Figure 3:
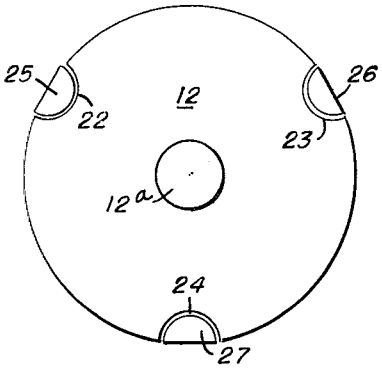
FIGS. 3–9 show schematically the sequential positions which the half-shafts of the first part assume during proper operation of the arming system.
Figure 4:
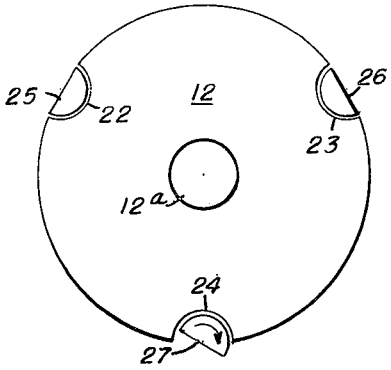
Figure 5:
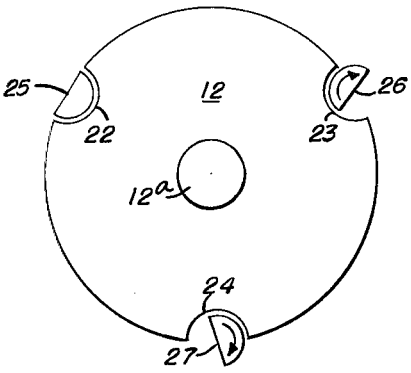

Rotation of rotor 12 in the direction of arrow A is prevented by half-shafts 25, 26 and 27, which are equally spaced at approximately 120° around the periphery of rotor 12. Half-shafts 25, 26 and 27 are received by matching hemispherical grooves 22, 23 and 24, respectively, so that each half-shaft is out of locking engagement with the rotor for only a very limited portion of one revolution. Prior to missile launching, the hemispherical portions of half-shafts 25, 26 and 27 are in full locking engagement with the hemispherical grooves 22, 23 and 24, as shown in FIG. 3. Coil springs 31, 32 and 33 are respectively connected at one end to half-shafts 25, 26 and 27, and at the other end to rotor 12, as shown in FIG. 1. Coil springs 31, 32 and 33 are wound when half-shafts 25, 26 and 27 rotate in the direction shown by arrow B, and when so wound thus urge half-shafts 25, 26 and 27 in an opposite direction to that of arrow B.

Gears 28, 29 and 30 are respectively fixed to the ends of half-shafts 25, 26 and 27, are driven in the direction of arrow B by gears 34, 35 and 36, respectively. Gears 34, 35 and 36 are affixed to shafts 37, 38 and 39, respectively, which are designed to be driven in the direction of arrow C by motors 40, 41 and 42, respectively. As shown in FIG. 1, gears 28, 29 and 30 are respectively proportionately larger in size, while gears 34, 35 and 36 are the same size and contain the same number of teeth. Motors 40, 41 and 42 have a constant speed output and, when energized , drive gears 34, 35 and 36 at the same constant speed. Motors 40, 41 and 42 are of a conventional slow-speed design and contain gears in the motors for reducing motor speed to some relatively low and constant speed output.

Figure 8:
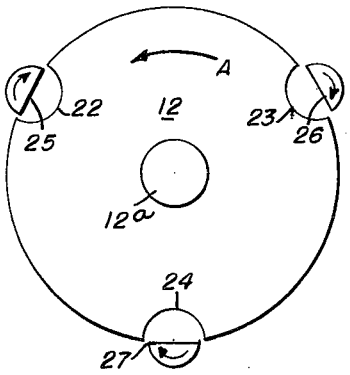
Figure 9:
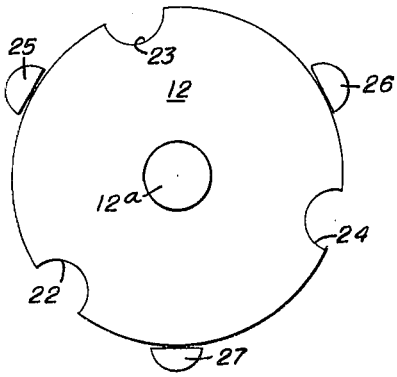

The rotor actuating unit 10 is designed to arm only in response to the receipt by motors 40, 41 and 42 of a predetermined sequence of energization signals at proper intervals and for a predetermined minimum time. It will thus be understood that the requirement that the rotor actuating unit arm only in response to such a predetermined sequence of energization signals virtually eliminates the possibility that arming will occur prematurely by a signal produced by an enemy source, by improper connections of wiring, or by short-circuiting in the wiring interconnecting the two parts of the arming system. The possibility that the motors 40, 41 and 42 will accidentally receive a series of sequential signals at exactly the proper sequence and for the necessary minimum duration to cause rotation of half-shafts 25, 26 and 27 to the position shown in FIG. 8 is extremely remote. Hence, by providing this requirement in the rotor actuating unit, the resulting arming system is safe against premature arming to a very high degree.

Figure 6:
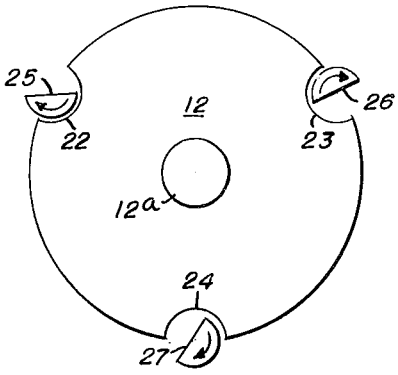

Since it is desired that the rotor actuating unit provide arming only in response to a predetermined sequence of signals, gears 28, 29 and 30 are proportional so that in response to the receipt by motors 40, 41 and 42 of this predetermined sequential energization, half-shafts 25, 26 and 27 will sequentially rotate at some predetermined speed and for some predetermined time until all half-shafts simultaneously assume the same unlocked position relative to rotor 12, as shown in FIG. 8. As shown in FIGS. 3–8, half-shaft 27 may begin to rotate at some predetermined time and at a predetermined speed dependent upon the rotational speed of gear 30. Rotation of half-shaft 27 may thereafter be followed by rotation of half-shaft 26 (FIG. 5) which, in turn, may be followed by rotation of half-shaft 25 (FIG. 6). Since gears 34, 35 and 36 rotate at a constant speed by properly proportioning gears 28, 29 and 30, each half-shaft may be caused to sequentially rotate at an increasing speed until all half-shafts finally assume the same unlocked position relative to rotor 12 (FIG. 8).

In light of the foregoing, it will be evident that before rotor 12 is released for rotation by the sequential unlocking of half-shafts 25, 26 and 27, motors 40, 41 and 42 must sequentially receive a predetermined series of energization signals at proper intervals, and the signals must continue for predetermined periods of time. Should the energization signal reaching any motor fail to continue for a period of time sufficient to drive any half-shaft from a hemispherical groove in rotor 12, the respective one of springs 31, 32 or 33 will return that half-shaft to the locking position shown in FIG. 3.

Motors 40, 41 and 42 receive electrical signals by means of lead wires 46, 47 and 48 which extend from package 15. Lead wires 46, 47 and 48 may be suitably sealed to package 15 so that the package may then be completely sealed against moisture and air, if so desired. The above described rotor actuating unit 10 in package 15 can be used in a wide variety of missiles, since it is independent of the environmental sensing means and depends for its operation only upon the receipt of the proper energization signals.

FIG. 2 shows the environmental sensing means, part 11, of the arming system of this invention. Part 11 may be incorporated in package 150 as shown, or its components may be placed at suitable locations in the missile. Package 150 has lead wires 46, 47 and 48 extending therefrom and may be sealed against moisture and air, if so desired.

One end of each lead wire 46, 47 and 48 feeds to a terminal in switches 50, 51 and 52, respectively. Switches 50, 51 and 52 are adapted to be permanently closed when the environmental sensing means with which each switch is associated reacts with its environment in a way commensurate with proper missile operation during flight. One of the environmental sensing means which closes a switch may take the form of a setback mechanism shown schematically by numeral 66 in switch 52. Setback mechanism 66 may be adapted to permanently close the switch 52 when the missile and the mechanism 66 are subjected to setback in the direction of arrow E as a result of proper missile launching.

Numeral 67 in switch 51 refers to a schematic representation of an expansible bellows which may be used as another environmental sensing element. Bellows 67 expands in response to an increase in barometric pressure resulting from increases in elevation of the missile during flight. As such, the bellows may be designed to close switch 51 when the missile attains some predetermined height.

Switch 50 houses a directional compass 68, a third form of environmental sensing element which may be used. This compass may be of the type which senses the altitude and azimuth of the missile, and when the missile is properly on course, may be caused to effect closure of switch 50.

While the setback mechanism 66, barometric pressure responsive mechanism 67 and the directional compass 68 are well known in the prior art, it will be evident that switches 50, 51 and 52 can be closed by any suitable environmental sensing or other means desired in a particular missile. For example, the thermal fuze disclosed in patent application Ser. No. 765,011 filed Oct. 2, 1958 by James M. Meek and Raymond W. Warren, can be used to close one of the switches in response to aerodynamic heat.

Distributor 53 comprises a disc 55 and a rotor disc 54 which is rotatable on and concentric with disc 55. Rotor disc 54 has affixed to its surface three V-shaped elements 56, 57 and 58 and is driven in the direction of arrow D by means of a toothed portion 62 thereon which is engaged by a gear 63, the latter being driven by clock 64 which is designated to initiate rotation of gear 63 in response to a condition such as missile launching. Such a clock is well known in the art and may readily be provided. Spaced around disc 55 are a first pair of contacts **70*a* and 70*b*, a second pair of contacts 71*a* and 71*b*, and a third pair of contacts 72*a* and 72*b*, each of which are respectively connected by means of wires to switches 50, 51 and 52 through battery source 49**.

Each of the V-shaped elements 56, 57 and 58 has a pair of contact ends **56*a* and 56*b*, 57*a* and 57*b*, and 58*a* and 58*b*, respectively, which are designed to contact the first, second and third pairs of contacts 70*a* and 70*b*, 71*a* and 71*b*, and 72*a* and 72*b*, respectively, upon rotation of rotor disc 54 through its cycle in the direction of arrow D. Clock 64 and gear 63 are flush with rotor disc 54 so that contact end 56*b* can pass over clock 64** during rotation thereof.

First contact pair **70*a* and 70*b* has shorter arcs than second contact pair 71*a* and 71*b*, which in turn has shorter arcs than third contact pairs 72*a* and 72*b*. Contact ends 56*a* and 56*b* of V-shaped element 56 are initially spaced farther from first contact pair 70*a* and 70*b* than are ends 57*a* and 57*b* of V-shaped element 57 from second contact pair 71*a* and 71*b*. Also, ends 58*a* and 58*b* of V-shaped element 58 are nearer to third contact pair 72*a* and 72*b* than ends 57*a* and 57*b* of V-shaped element 57 are to second contact pair 71*a* and 71*b*. The V-shaped elements are designed in cooperation with the contact ends of the V-shaped elements of rotor disc 54 so that upon rotation thereof in the direction of arrow D, ends 58*a* and 58*b* first engage third contact pair 72*a* and 72*b*; a predetermined time thereafter, ends 57*a* and 57*b* engage second contact pair 71*a* and 71*b*; and subsequently, ends 56*a* and 56*b* engage first contact pair 70*a* and 70*b*. Also, the lengths of the third pair of contacts 72*a* and 72*b*, which are first engaged by contact ends 58*a* and 58*b*, and the lengths of the second pair of contacts 71*a* and 71*b*, which are next engaged by contact ends 57*a* and 57*b*, are designed so that they remain in engagement therewith until the first pair of contacts 70*a* and 70*b* becomes engaged with contact ends 56*a* and 56*b*, and all pairs of contacts continue in contact with their respective contact ends for some predetermined time. Thus, contact between the ends of V-shaped elements 56, 57 and 58 and their respective contact pairs will occur at a predetermined time sequence, depending upon the spaced relation between the pairs of contacts in conjunction with the spacing of the contact ends of the V-shaped elements. The lengths of the pairs of contacts 70*a* and 70*b*, 71*a* and 71*b*, and 72*a* and 72*b*, are chosen to permit these contacts to remain engaged with their respective contact ends 56*a* and 56*b*, 57*a* and 57*b*, and 58*a* and 58*b*, of the V-shaped elements 56, 57 and 58, until all are simultaneously engaged for some predetermined time. The system is arranged so that at this predetermined time the motors will have driven each of the half-shafts to a position where they are no longer in locking engagement with the rotor as shown in FIG. 8, thereby permitting the rotor 12 to rotate to a position where the powder-filled cavity 21 on shaft 12*a* is aligned with the explosive train elements 19 and 20**.

The environmental conditions which are utilized to close switches 50, 51 and 52 must each occur at least before some predetermined time during the flight of the missile, in order to cause arming. This is because switches 50, 51 and 52 have one terminal connected to contacts **70*a*, 71*a* and 72*a*, respectively, and unless each switch is closed before the respective contact end 56*a*, 57*a* and 58*a* to which it is connected engages its respective contact 70*a*, 71*a* and 72*a*, the circuit to the corresponding pair of wires 46, 47 and 48 will remain open. As a result, battery source 49 will not provide an energization signal to the associated motors 40, 41 and 42 for the predetermined period of time sufficient to cause unlocking of half-shafts 25, 26 or 27. It will be understood, therefore, that the speed of rotation of the rotor disc 54, which is driven by clock 64**, must be properly chosen in conjunction with the expected closing times of the environmental sensing elements.

The operation of the arming system can be best described by assigning theoretical time values to the operating elements of the system. Initiation of distributor 53 occurs upon missile launching. Clock 64 thereupon proceeds to slowly drive rotor disc 54 in the direction of arrow D at some predetermined speed from the position shown in FIG. 2.

Switch 52 is positioned so that when the missile is fired or launched in a direction opposite to that shown by arrow E (FIG. 2), the forces of set-back act in the direction of arrow E, causing setback mechanism 66 to close switch 52. Rotation of rotor disc 54 is relatively slow and about 30 seconds after initiation of clock 64, contact ends **58*a* and 58*b* simultaneously engage contact pair 72*a* and 72*b*, respectively. After switch 52 has been closed, battery 49 produces an energization signal through wires 48 to energize motor 42, which then rotates half-shaft 27, as shown in FIGS. 4–8**.

Before contact ends **57*a* and 57*b* make contact with contact pair 71*a* and 71*b*, switch 51 must have closed in response to an increase in atmospheric pressure in bellows 67 which is caused by missile flight. Contact pairs 71*a* and 71*b*, and 72*a* and 72*b*, are spaced so that about 10 seconds after contact ends 58*a* and 58*b* have engaged contact pair 72*a* and 72*b*, at which time the proper altitude to cause bellows 67 to close switch 51 should have been reached, contact ends 57*a* and 57*b* engage contact pair 71*a* and 71*b*, respectively. When contact ends 57*a* and 57*b* engage contact pair 71*a* and 71*b*, battery 49 produces an energization signal through wires 47 to energize motor 41. Motor 41 thereupon rotates half-shaft 26, as shown in FIGS. 5–8**.

Figure 7:
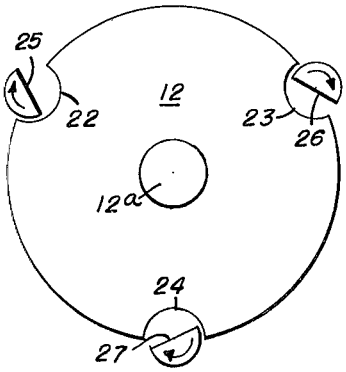

10 seconds after contact ends 57*a* and 57*b* engage contact pair 71*a* and 71*b*, contact ends 56*a* and 56*b* engage contact pair 70*a* and 70*b*, respectively. Any time prior to contact between contact ends 56*a* and 56*b* and contact pair 70*a* and 70 *b*, switch 50 must have closed, indicating that the missile is on course. Battery source 49 then produces an energization signal through wires 46 to energize motor 40 which rotates half-shaft 25, as shown in FIGS. 6–8.

The arcs of contact pairs 70*a* and 70*b*, 71*a* and 71*b*, and 72*a* and 72*b* are of predetermined lengths so that rotating contact ends 58*a* and 58*b* will engage contact pair 72*a* and 72*b* for 30 seconds; contact ends 57*a* and 57*b* will engage contact pair 71*a* and 71*b* for 20 seconds; and contact ends 56*a* and 56*b* will engage contact pair 70*a* and 70*b* for 10 seconds. The spacing and lengths of the arcs of the contact pairs can easily be determined by those skilled in the art, since the speed of rotation of rotor disc 54 is known, while the contact pairs are spaced concentrically with respect to disc 55 and rotor disc 54. It will be understood that the length of the arcs determine the duration of the energizing signals, while the spacing determines the time sequence of the signals. Thus, motor 42 receives an electrical signal from battery 49 for 30 seconds, while motors 41 and 40 receive electrical signals for periods of 20 and 10 seconds, respectively. Gears 28, 29 and 30 are proportioned to drive half-shafts 25, 26 and 27 at respectively greater speeds at the unlocked position relative to rotor 12 (FIG. 8). Thus, gear 30 is three times as large as gear 28, while gear 29 is twice as large as gear 28, so that all of the half-shafts arrive at the unlocked position 30 seconds after the first shaft is started.

It will be apparent that the embodiments shown are only exemplary and that various modifications can be made in construction and arrangement within the scope of the invention as defined in the appended claims.

I claim as my invention:

1. An arming system for use in an ordnance missile, said system consisting of two parts contained within said missile and electrical wiring connections for transmitting electrical signals therebetween, the first part comprising: an arming rotor, a spring biasing said rotor for rotation to an armed position, means for locking said rotor against rotation to said armed position, said means adapted to unlock said rotor for rotation when said means receives a series of electrical signals of predetermined duration in a predetermined sequence from said electrical wiring connections; the second part comprising: a series of environmental sensing switches each adapted to close in response to a predetermined condition which the missile experiences during proper missile flight, a distributor, contacts adapted to be closed by said distributor in a predetermined sequence and for predetermined time periods, and a source of electrical power connected to said contacts and to said electrical wiring connections so that said series of electrical signals is applied to said electrical wiring connections.

2. An arming system for use in an ordnance missile, said system consisting of two parts contained within said missile and electrical wiring connections therebetween, one of said parts being a rotor actuating unit and comprising: a rotatable arming rotor, spring means biasing said rotor to an armed position, a series of individual locking members constructed and arranged to unlock said rotor for rotation when each of said locking members is driven in a predetermined sequential order at a predetermined speed and for a predetermined period of time, a plurality of electric motors each communicating with one of said locking members, said motors connected to said wiring connections, gear means connecting each locking member to the output of its motor, the output speed of said motors being the same, said gear means being proportioned so that said individual locking members are driven at predetermined speeds in a predetermined sequence so that each member simultaneously assumes an unlocked position relative to said rotor after said motors have received electrical signals in said predetermined sequential order and for said predetermined period of time; the other part being an environmental sensing unit and comprising: a series of switches corresponding in number to the number of said motors, each of said switches being associated with one of said motors, environmental sensing means operatively connected to said switch and positioned so as to close each switch at some predetermined time in response to a predetermined condition occurring as a result of proper missile flight, a distributor having a rotor disc and a series of pairs of contacts positioned thereon to close sequentially upon rotation of said disc, one contact of each pair being electrically connected to one of said switches and to said electrical connections, and an electrical power source for producing electrical energization signals, the other contact of each pair being connected to said power source and to said electrical connections, proper missile operation causing said energization signals to be applied to said motors through said electrical wiring connections to cause said motors to drive individual locking members to positions where all of said locking members simultaneously unlock said rotor for spring biased rotation, whereupon rotation of said rotor arms said missile.

3. The arming system as defined in claim 2, in which said locking members comprise a series of half-shafts, said rotor is provided with a series of hemispherical grooves equispaced around the outer periphery thereof, said half-shafts being rotatable in said grooves from a locking to an unlocking position, and coil spring means are provided connecting each half-shaft to said rotor and positioned to wind upon rotation of said half-shafts from said locking position, said coil spring means urging said half-shafts to return to said locking position upon cessation of half-shaft rotation.

4. An arming system for use in an ordnance missile consisting of two parts contained within said missile and electrical wiring connections for transmitting electrical signals therebetween, said first part comprising: an arming rotor, a spring biasing said rotor for rotation to an armed position, a plurality of locking members, a series of drive means for sequentially driving said locking members at a predetermined speed and for a predetermined time so that said members rotate to a position where said members simultaneously unlock said rotor and for individually rotating all of said locking members to a position whereby said members simultaneously unlock said rotor in response to a predetermined sequential series of electrical signals of predetermined duration applied to said series of drive means; said second part comprising: a series of switches, environmental sensing means associated with each switch of said series and adapted to close said switches in response to a predetermined environmental condition which occurs as a result of proper missle flight distributor means adapted to sequentially close a series of contacts at and for said predetermined period of time, and a source of electrical power in circuit with said switches and said distributor so as to provide a series of sequential electrical signals at and for said predetermined period of time to said series of drive means in said first part, thereby unlocking said rotor for rotation to said armed position.

* * * * *